United States Patent [19]

Jones et al.

[11] Patent Number: 4,669,576

[45] Date of Patent: Jun. 2, 1987

[54] SAFETY LADDER FOOT

[76] Inventors: Leroy W. Jones, 1362 Hartford Ave., Akron, Ohio 44320; George Spector, 233 Broadway, RM 3615, New York, N.Y. 10007

[21] Appl. No.: 857,380

[22] Filed: Apr. 30, 1986

[51] Int. Cl.[4] ..... E06C 7/46

[52] U.S. Cl. ..... 182/108; 182/204

[58] Field of Search ..... 182/107, 108, 109, 110, 182/111, 204, 205; 248/188.1, 188.8, 188.9

[56] References Cited

U.S. PATENT DOCUMENTS

| | | | |
|---|---|---|---|
| 111,660 | 2/1871 | Martz | 182/108 |
| 281,245 | 7/1883 | Degenhart | 182/108 |
| 1,431,068 | 10/1922 | Waney | 182/109 |

*Primary Examiner*—Reinaldo P. Machado

[57] ABSTRACT

A safety ladder foot is provided for stabilizing a side rail of a ladder and consists of a leg extending downwardly from side of a receptacle that receives bottom portion of the side rail. The leg has a beveled distal end to enter soft ground to prevent the side rail from slipping. A non-skid flat pad member has a chamber to receive the beveled distal end of the leg to prevent the side rail from slipping on a hard surface.

4 Claims, 5 Drawing Figures

SAFETY LADDER FOOT

BACKGROUND OF THE INVENTION

The instant invention relates generally to ladders and more specifically it relates to a safety ladder foot.

Numerous ladders have been provided in prior art that are adapted for climbing and descending and may have shoes at bottom of their side rails to prevent slipping. While these units may be suitable for the particular purpose to which they address, they would not be as suitable for the purposes of the present invention as heretofore described.

SUMMARY OF THE INVENTION

A principle object of the present invention is to provide a safety ladder foot that will overcome the shortcomings of the prior art devices.

Another object is to provide a safety ladder foot that attaches to bottom of ladder to prevent the ladder from slipping on soft ground and on a hard flat surface.

An additional object is to provide a safety ladder foot that has a rubber pad attachment which is adjustable to different angles of the hard surface.

A further object is to provide a safety ladder foot that is simple and easy to use.

A still further object is to provide a safety ladder foot that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
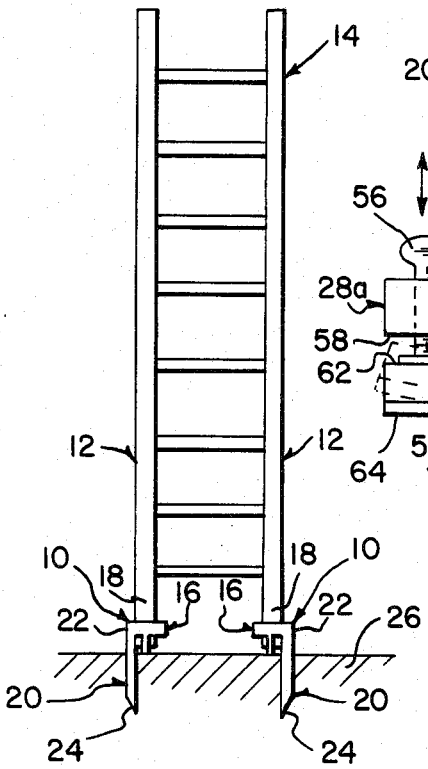
FIG. 1 is a front elevational view of a ladder with the invention in place and used in the soft ground.
Figure 2:
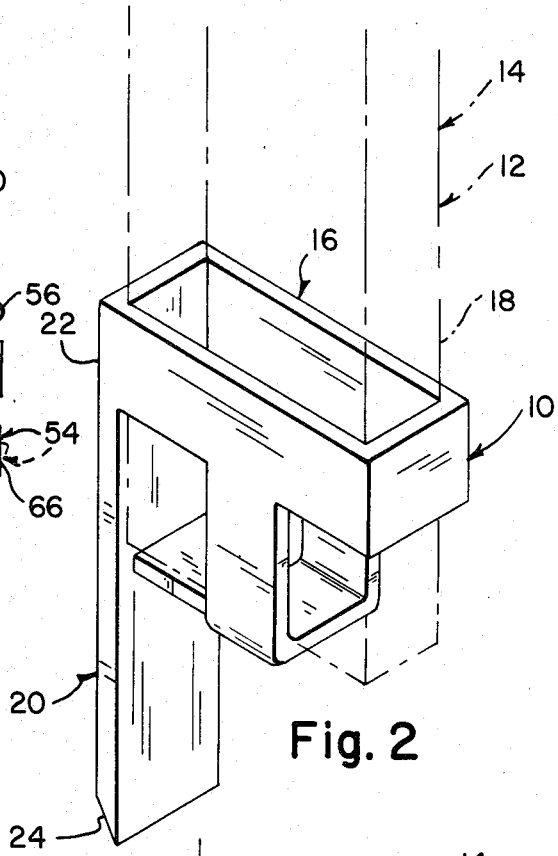
FIG. 2 is an enlarged perspective view of the invention.

Turning now descriptively to the drawings, in which similar reference characters denote similar elements throughout the several views, FIGS. 1 and 2 illustrate a safety ladder foot 10 for stabilizing each side rail 12 of a ladder 14. The foot 10 consists of a recepticle 16 to receive bottom portion 18 of the side rail 12. A leg 20 extends downwardly from side 22 of the recepticle 16. The leg 20 has a beveled distal end 24 to enter soft ground 26 to prevent the side rail 12 from slipping on the soft ground 26.

Figure 3:
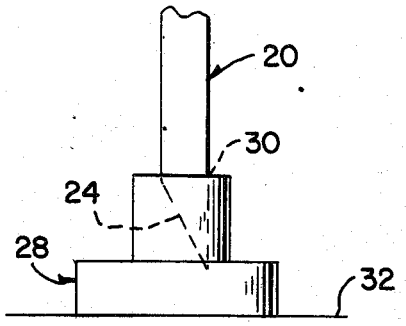
FIG. 3 is a front elevational view of a rubber pad attached to the foot to be used on a hard flat surface.

In referring to FIG. 3 a non-skid pad member 28 is shown having a chamber 30 to receive the beveled distal end 24 of the leg 20 to prevent the side rail 12 from slipping on a hard surface 32 such as concrete or the like.

Figure 4:
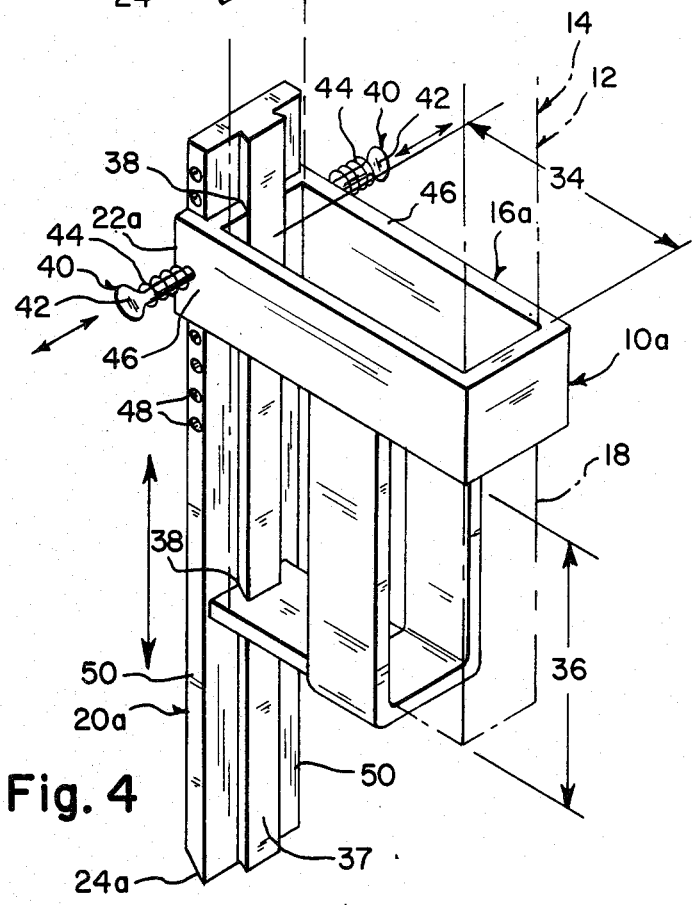
FIG. 4 is an enlarged perspective view of a modification showing an adjustable foot that can be used vertically for placement in the soft ground and horizontally for placement on the hard flat surface.

In referring the FIG. 4 a modified safety ladder foot **10*a* is shown. The recepticle 16*a* has a top opening 34 and a side opening 36 opposite the leg 20*a* being of equal size with width of the bottom portion 18 of the side rail 12. In one instance the recepticle 16*a* can be positioned with the top opening 34 to receive the bottom portion 18 of the side rail 12 to prevent the side rail from slipping on the soft ground 26. In another instance the recepticle can be positioned with the side opening 36 to receive the bottom portion 18 of the side rail 12 to prevent the side rail from slipping on the hard surface 32**.

The leg **20*a* has a tongue 37 and is slideably adjustable to the side 22*a* of the recepticle 16*a* which has a groove 38 so that the leg 20*a* can be adjusted to any desired length. A device 40 is for securing the leg 20*a* within the track 38 to any desired length. The securing device 40 includes a pair of locking pins 42 being spring loaded at 44 and mounted within sides 46 of the recepticle 16*a* adjacent to the leg 20*a*. The leg has a plurality of spraced holes 48 along both edges 50 adjacent to the locking pins 42. When the locking pins are pulled outwardly from the sides 46 of the recepticle 16*a* the leg 20*a* can be slideably adjusted to any desired length and then locked thereto when the locking pins 42** are released.

Figure 5:
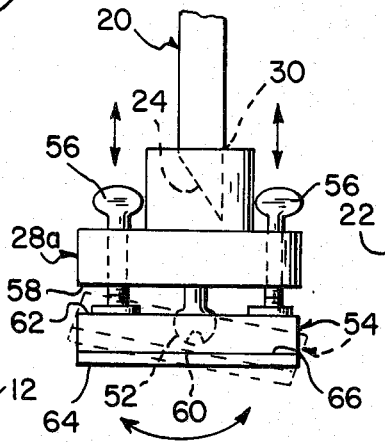
FIG. 5 is a front elevational view of a modified rubber pad attached to the foot which is adjustable to different angles.

In referring to FIG. 5 a modified pad member **28*a* is shown that includes a ball joint 52, a disc 54 and a pair of adjustment bolts 56. The ball joint 52 is mounted to center of underside 58 of the pad member 28*a*. The disc 54 has a central socket 60 on one side 62 and a non-skid surface 64 on other side 66. The socket 60 receives the ball joint 52 so that the disc 54 can swivel in any direction. Each of the bolts 56 is threaded through the pad member 28*a* to properly adjust the disc 54 to any desired angle so that the side rail 12 can be prevented from slipping on a slanted hard surface 32**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A safety ladder foot for stabilizing a side rail of a ladder which comprises:

(a) a recepticle to receive bottom portion of said side rail; and (b) a leg extending downwardly from side of said receptacle, said leg having a beveled distal end to enter soft ground to prevent said side rail from slipping on said soft ground, further comprising a non-skid, flat pad member having a chamber to receive said beveled distal end of said leg to prevent said side rail from slipping on a hard surface, wherein said receptacle further has a top opening and a side opening opposite said leg being of equal size with width of said bottom portion of said side rail so that in one instance said receptacle can be positioned with said top opening to receive said bottom portion of said side rail to prevent said side rail from slipping on said soft ground and in another instance said receptacle can be positioned with said side opening to receive said bottom portion of said side rail to prevent said side rail from slipping on said hard surface.

2. A safety ladder foot as recited in claim 1, further comprising:

(a) said leg having a tongue slideably adjustable to said side of said receptacle having a groove so that said leg can be adjusted to any desired length; and (b) means for securing said leg within said track to any desired length.

3. A safety ladder foot as recited in claim 2, wherein said securing means includes:

(a) a spring loaded locking pin mounted to within side of said receptacle adjacent to said leg; and (b) said leg having a plurality of spaced holes along one edge adjacent to said locking pin so that when said locking pin is pulled outwardly from said side of said receptacle said leg can be slideably adjusted to any desired length and then locked thereto when said locking pin is released.

4. A safety ladder foot as recited in claim 1, wherein said pad member further comprises:

(a) a ball joint mounted to center of underside of said pad member;

(b) a disc having a central socket on one side and a non-skid surface on other side, said socket receives said ball joint so that said disc can swivel in any direction; and (c) a pair of adjustment bolts, each of which is threaded through said pad member to properly adjust said disc to any desired angle so that said side rail can be prevented from slipping on a slanted hard surface.

* * * * *